United States Patent [19]

Price

[11] Patent Number: 4,550,913

[45] Date of Patent: Nov. 5, 1985

[54] COIN CROSSING GAME DEVICE

[76] Inventor: William J. Price, 5731 Kingsgate Dr., Apartment C, Orlando, Fla. 32808

[21] Appl. No.: 653,843

[22] Filed: Sep. 24, 1984

[51] Int. Cl.[4] ..... A63F 7/06

[52] U.S. Cl. ..... 273/126 R; 273/129 L

[58] Field of Search ..... 273/126 R, 119 R, 118 R, 273/94, 110, 116, 85 E, 85 R, 85 F, 1 GA, 1 GB

[56] References Cited

U.S. PATENT DOCUMENTS 3,462,149 8/1969 Grusin ..... 273/126 R 3,746,314 7/1973 Reisinger ..... 273/129 L 4,294,448 10/1981 Oler ..... 273/110

4,513,971 4/1985 Baldwin ..... 273/153

*Primary Examiner*—Richard C. Pinkham

*Assistant Examiner*—T. Brown

*Attorney, Agent, or Firm*—Edward M. Livingston

[57] ABSTRACT

This device involves a game of skill and coordination, the object of which is to push a coin across a board containing a maze of holes and obstacles and into a coin box at the other end of the board, with the aid of only one hand-held game tool similar to a knitting needle.

2 Claims, 4 Drawing Figures

COIN CROSSING GAME DEVICE

BACKGROUND OF THE INVENTION

This invention relates to game devices, particularly those games involving the crossing of mazes and obstacles with coins.

Although the prior art reveals no game devices exactly like the instant invention, maze-like games have been available for many years. For instance, U.S. Pat. No. 4,924,448, dated Oct. 13, 1981, by Oler, teaches moving a ball over a field of apertures withut allowing the ball to fall in the apertures. U.S. Pat. No. 3,388,483, dated June 18, 1968, by Weisbecker, shows a toy that allows one to move a ball through a torturous path without letting it fall. Unfortunately, none of these games is designed to be played with a coin or to utilize only manual tools to accomplish its objectives.

Another drawback is that the majority of these prior games require two players. An even further disadvantage is that such games often do not provide for a change of the game board, thereby resulting in boredom to the player.

The instant provides a device which requires skill, coordination, manual dexterity and concentration. The board contained in the game device consists of numerous potholes and obstacles over and across which a coin, such as a quarter, must be maneuvered with the aid of one manual tool only, from one end of the board to the other end, at whch there is a coin box, awaiting the acceptance of said coin. This invention is particularly good for training and testing eye and hand coordination, depth perception and other skills of growing children. The invention also provides for a removable game board in order that the game baord can be replaced with a different series of mazes and obstacle holes, to eliminate the boredom associated with playing the same game over and over again.

SUMMARY OF THE INVENTION

The object of this invention is to provide a game device which is comprised of a maze-like board containing obstacles and potholes which is playable with ordinary coins.

A further object of this device is to provide an educational game which teaches and trains numerous skills and discipline, such as eye and hand coordination, concentration and patience, all traits of particular importance to children.

An even further object of this device is to provide a game which provides various game boards presenting different challenges, which eliminates the boredom associated with most games of this type.

The instant invention provides the aforereferenced objects and other objects by providing a game consisting of a horizontal game board containing a maze of obstacles and apertures, said game board being enclosed between transparent surfaces above and below. The game device is a good educational tool for children in that it requires considerable skill, concentration and coordination to manipulate a coin using only one tool, similar to a long knitting needle, which is used to push the coin through and over various obstacles, potholes and bridges. The coin must be pushed and maneuvered in a very careful manner, because even the slightest false move will cause the coin to fall into a pothole and the player will have to begin again by inserting another coin.

The game device also eliminates the monotony associated with most games by providing a means of changing the game board merely by removing the top glass cover of the board, inserting a new game board in place of the existing one, and replacing the glass cover.

The operational rules of the game are simple, but mastery of the game is difficult. The game is played by one person at a time, using only one coin. The coin is placed at the center front of the game and pushed by the player with the game tool over and across the game board to the coin box in the back center of the game device. The coin is slid or rolled on a flat surface through and over the game board avoiding the potholes. If the coin falls into the pothole, then the player must begin again. The player that is successful gets all the coins in the coin box which were lost by previous unsuccessful players.

BRIEF DESCRIPTION OF THE DRAWINGS

The drawings included with this patent application are as follows.

DETAILED DESCRIPTION OF THE PREFERRED EMBODIMENTS

Figure 1:
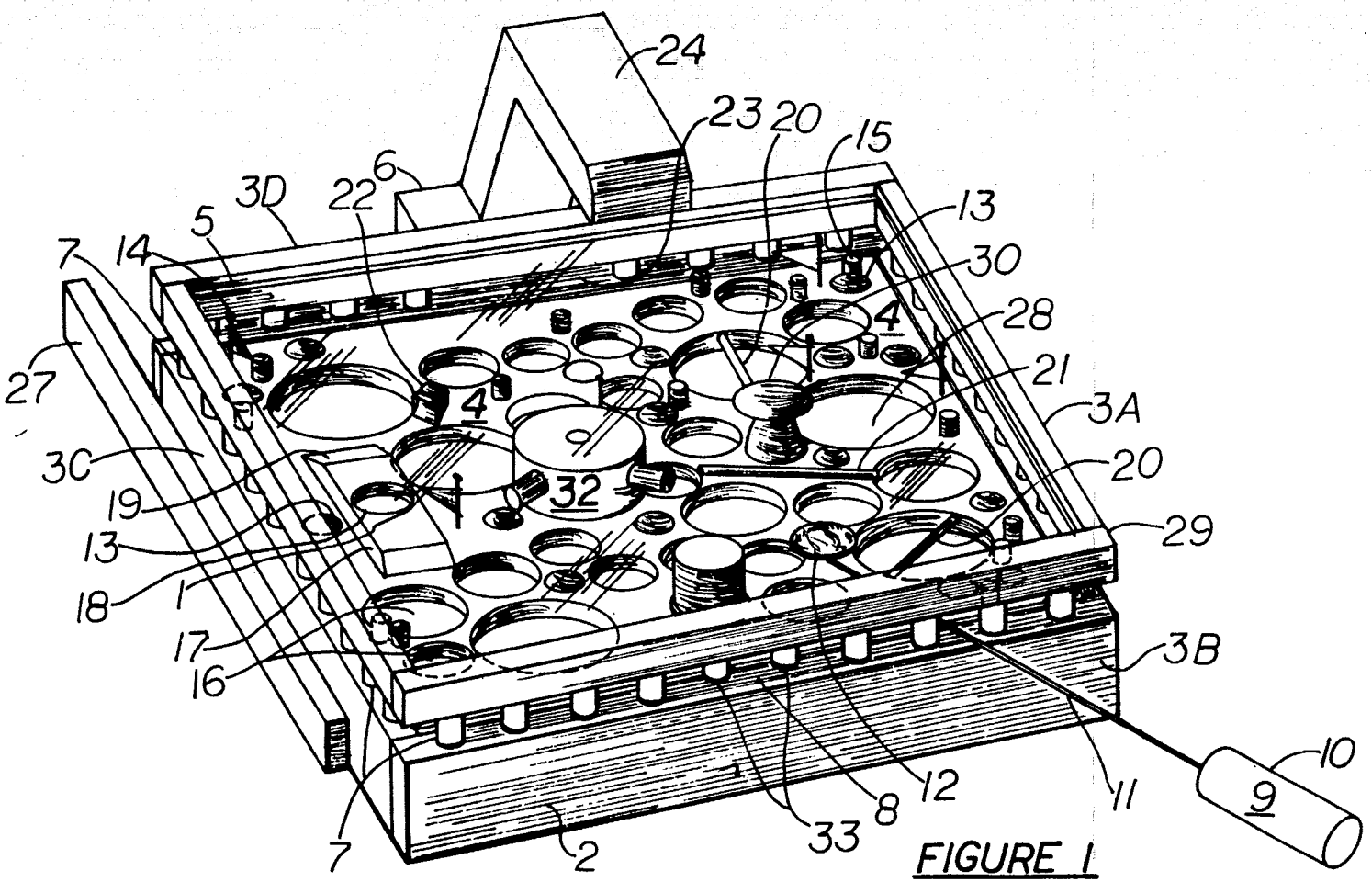
FIG. 1 is a perspective view of the game device.
Figure 2:
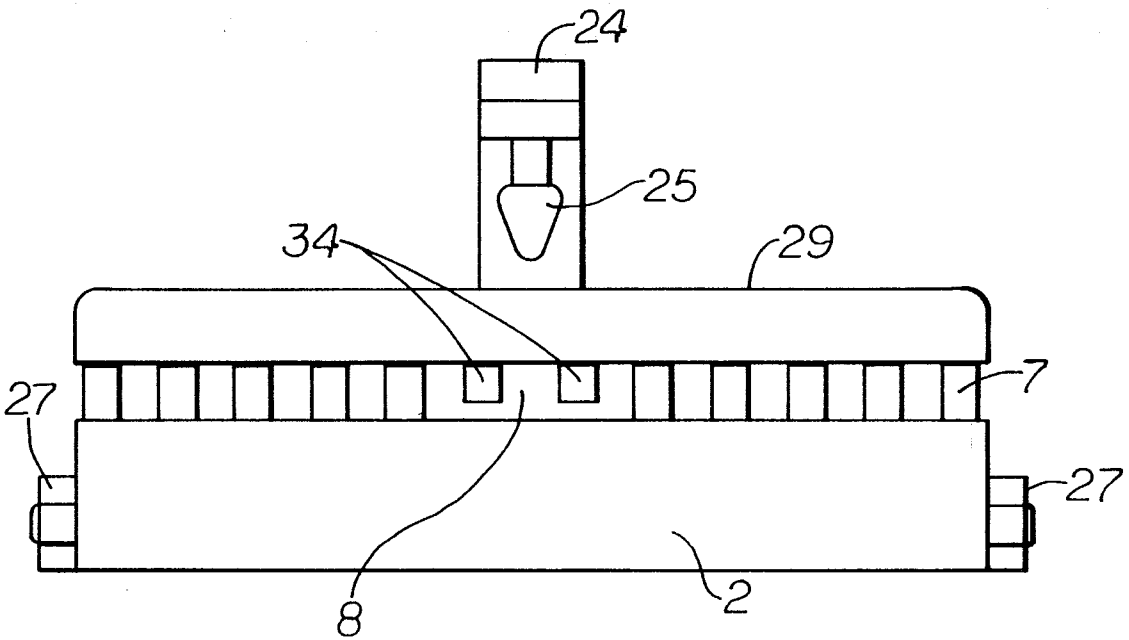
FIG. 2 is a frontal side view of the game device.
Figure 3:
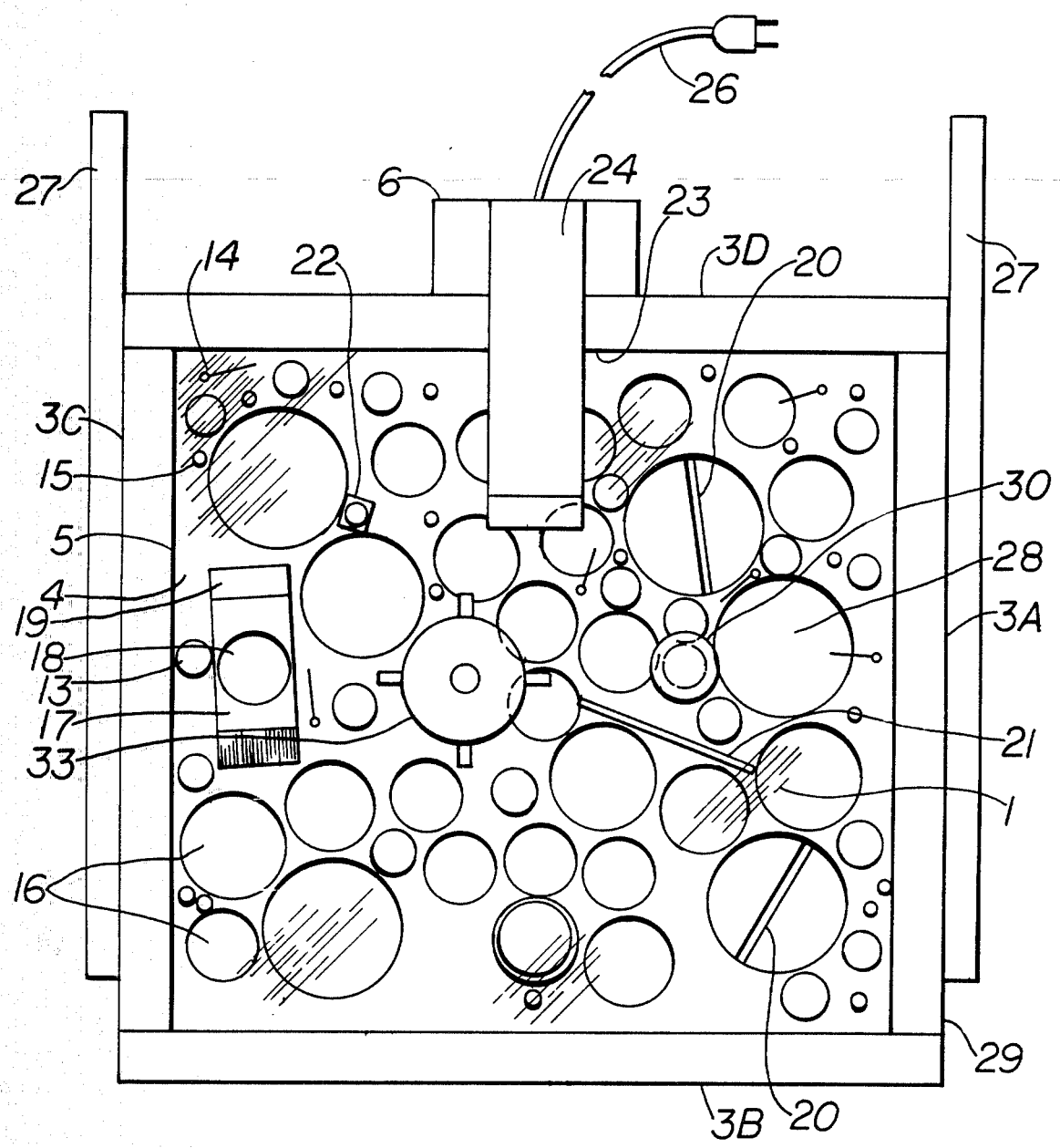
FIG. 3 is a top view of the game device.

Referring now in detail to the drawings, FIGS. 1 through 4 illustrate the game in various views. As shown in the drawings in FIG. 1, the game consists of several main components-top portion 29, a bottom portion 2, and game board 4.

All portions may be made of plastic, wood or metal, preferably plastic, which is stamped in molds of several pieces and assembled thereafter.

The top portion of the game device 29 contains a glass cover 1, which is secured in a retaining notch 5 around the inside of the top portion 29. The top portion 29 also contains two short dowels 34, which protrude downward at the front entrance 8 (or starting position) of the game. The bottom portion of the game device designated by 2 is composed of four sides 3*a*, 3*b*, 3*c* and 3*d*, attached together to form a square-shaped container. The dowels 7 are made of wood, plastic or other material and extend from the top of each of the four sides. These dowels 7 are designed to fit in the holes of the bottom side of the top portion 29 so that the top portion 29 can be held securely in place when the game is in use, yet at the same time allow easy removal of the top portion 29, when the game board 4, is changed.

The bottom portion 2 of this game, like the top portion 29, also has a transparent bottom 28, which can be made of glass or transparent plastic, the purpose of which is to catch coins which fall through the various potholes 16, as the game is played. Supporting blocks designated by 32, as shown in FIG. 4, are attached to the inside corners of the bottom portion 2 and are provided to support the game board 4.

The game board 4, itself, consists of a square piece of wood or plastic having little thickness into which numerous potholes 16 are cut and to which other obstacles are attached. These potholes 16 and obstacles appear in a maze-like fashion to provide a greater challenge to the player. These obstacles include such items as round pegs 13, flags 14, elevated pieces 17 with holes 18 and inclines 19 thereon, pushpins 15, barriers 21 and turning wheels 33. Narrow bridges 20 are provided to enable the player to traverse some of the larger potholes 16.

The game is played by one player who uses the game tool, 9, to push a coin, such as a quarter, shown by 12, from a coin entrance 8, through the maze-like game board 4 to the coin box opening 23 and into the coin box 6. The game tool 9 has a needle-like extension 11 with a handle 10 to maneuver the coin 12 over the game board 4 without the coin 12 falling through the potholes 16. The coin 12 can be pushed over the game board 4 in either a flat position or stood up and rolled across the game board. A light stand 24, with light bulb 25, provides light to the game board 4 during play. The entire game device is designed to be attached to the wall with a wall bracket 27, and via an electrical cord 26, plugged into a household circuit for electrical power to the light bulb or even to make the obstacles electrical, is so desired. When mounted to the wall, the entire game device can be folded into an almost flat position against the wall, thereby taking up little or no space when not in use.

Figure 4:
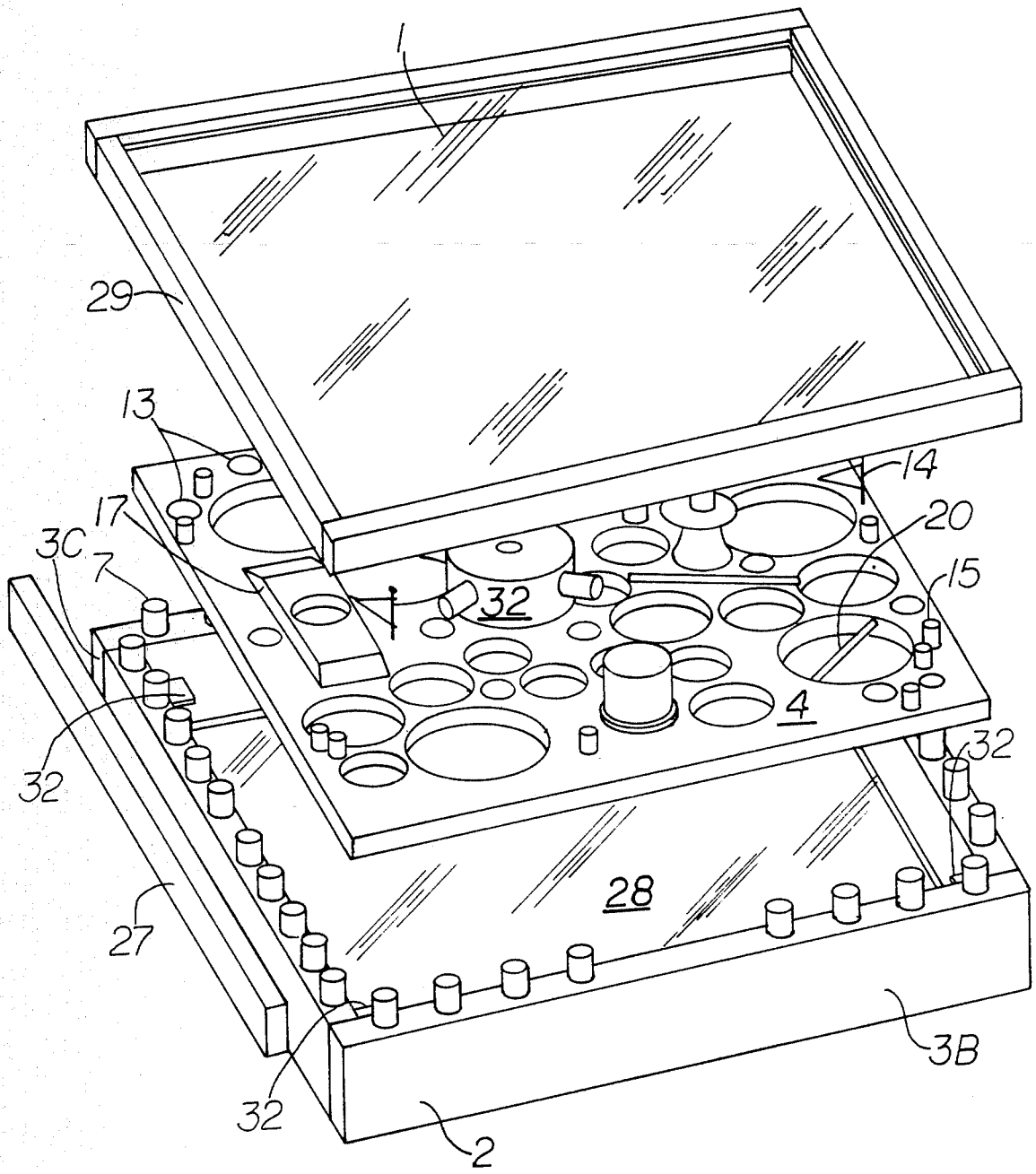
FIG. 4 is a exploded perspective view showing the placement of the game board.

As illustrated in FIG. 4, if the player desires a different game board, with a different maze requiring various levels of different skills, the game board 4 can be substituted merely by lifting the top portion 29 of the game device, removing the game board 4, inserting the new board so that it rests on the supports 32 and resetting the top portion 29 on the dowels 7.

In summary, this invention, as described in detail hereinabove, provides a game of skill requiring good eye-hand coordination, concentration and patience, and therefore, is a particularly good teaching tool and educational game for children. Moreover, it is one of the only maze-like games which can be played with an ordinary coin and which provides a means of changing game boards to eliminate boredom.

Although the embodiment of this invention has been described in detail above, various modifications and changes may be made without departing from the spirit and scope of this invention, and thus, are intended to be included herein.

Having thus described my invention in detail, I claim the following:

1. A game device for use with a coin comprising;

a square-shaped horizontal lower portion, said lower portion being a square-shaped, planar transparent member and having side members extending upwards and along each side of said transparent member to form a tray-like configuration; each of said side members having spaced apart dowel elements extending upwardly therefrom, a support element being attached to said device at the intersections of said side members; a planar game board supported on said support elements, said game board having numerous holes cut therethrough and numerous obstacles attached to the top surface thereof; said game device further comprising an upper portion having a configuration substantially similar to said lower portion and having a transparent planar surface; said upper portion having four sides, each side having recesses in the underside thereof; said recesses being positioned to receive a respective one of said dowels whereby said top portion is supported over said game board and lower portion in substantially parallel spaced relationship; and at least one hand-held game tool having a cylindrical handle thereon, said tool having a shape similar to a knitting needle and being provided to maneuver a coin across said game board.

2. The game device of claim 1 wherein a source of light is attached to said lower portion thereof, said light source extending upward and positioned over said upper portion of said game board for illumination thereof.

* * * * *